US007711297B2

(12) United States Patent
Kawatani et al.

(10) Patent No.: US 7,711,297 B2
(45) Date of Patent: May 4, 2010

(54) BELT AND IMAGE FORMING DEVICE USING THE SAME

(75) Inventors: Tetsuya Kawatani, Kanagawa (JP); Yukio Hara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 684 days.

(21) Appl. No.: 11/590,792

(22) Filed: Nov. 1, 2006

(65) Prior Publication Data

US 2007/0280747 A1 Dec. 6, 2007

(30) Foreign Application Priority Data

May 31, 2006 (JP) ..... 2006-152694

(51) Int. Cl.
*G03G 15/01* (2006.01)

(52) U.S. Cl. ..... 399/302; 399/303; 399/162; 399/278; 399/288; 399/313; 399/329; 399/352

(58) Field of Classification Search ..... 399/162, 399/278, 288, 302, 303, 313, 329, 352
See application file for complete search history.

(56) References Cited

U.S. PATENT DOCUMENTS

2005/0031377 A1* 2/2005 Kabata et al. ..... 399/165
2006/0222422 A1* 10/2006 Takenaka et al. ..... 399/302
2007/0206979 A1* 9/2007 Ohta ..... 399/302

FOREIGN PATENT DOCUMENTS

JP A 57-76579 5/1982
JP A 2001-117377 4/2001

OTHER PUBLICATIONS

Machine translation of JP 2000-122439 A.*

* cited by examiner

*Primary Examiner*—David M Gray
*Assistant Examiner*—Ruth N Labombard
(74) *Attorney, Agent, or Firm*—Oliff & Berridge, PLC

(57) ABSTRACT

The invention provides a belt including a belt base having elasticity and a projection member having elasticity which is provided along at least one edge of the belt base so as to project from the belt base, and an adhesive layer which bonds the belt base and the projection member, wherein the ten-point average roughness Rz in the region of the belt base to be bonded with the projection member is about 4 μm or more and the ten-point average roughness Rz in the region of the projection member to be bonded with the belt base is about 6 μm or more.

18 Claims, 6 Drawing Sheets

BELT AND IMAGE FORMING DEVICE USING THE SAME

BACKGROUND (i) Technical Field

The present invention relates to a belt, and, particularly, to a belt suitable as an intermediate transfer belt and as a sheet conveyer belt that are used in image forming devices such as electrophotographic copying machines and printers, and to an image forming device provided with the belt.

(ii) Related Art

In image forming devices such as copying machines and printers utilizing a electrophotographic system, an electrostatic latent image formed on the surface of an image carrier by known electrophotographic processes is developed on the image carrier to form a toner image thereon. Then, this toner image is transferred electrostatically onto a recording medium using a transfer device, thereafter the toner image is fixed onto the recording medium, for example, by means of a heat fixing mechanism, to form an image.

When a belt is used in the transfer device that transfers the toner image onto the recording medium, the belt is trained over plural tension rolls and rotated in a predetermined running direction, thereby enabling conveying of the recording medium in a circulating manner. In transfer devices of such type, a phenomenon may occur, so-called belt walk, wherein the belt is shifted in the direction of the axis of the tension rolls, due to the dimensional tolerance of component parts constituting the transfer device or variation in parallelism and outer diameter of the tension rolls. If the image forming device is driven when this belt walk is present, the belt may be wrinkled, causing image unevenness, or even break.

On the other hand, an intermediate transfer type transfer device is used as the transfer device in some cases, from the viewpoint of advantages in conveying of paper, and the like. A system of intermediate transfer type has already been proposed, in which toner images of respective color components are sequentially formed on the image carrier, then the toner images of respective color components are primarily transferred onto the intermediate transfer body temporarily, thereafter the transferred multilayer toner images formed on the intermediate transfer body are secondarily transferred onto the recording medium, collectively, and thereby a color image is obtained. As the intermediate transfer body, one in the form of a belt or drum is commonly used. When a belt is used as the intermediate transfer body, belt walk may occur, as is the case of the aforementioned transfer device not using the intermediate transfer body.

Also, a belt having elasticity is used as the belt to meet the needs for higher quality image and operation speed, in some cases. Generally, in image forming devices using an elastic belt, the elastic belt is used in an expanded manner. Therefore, when a member forming a rib is attached to the elastic belt, it is more likely that the rib is peeled off than in the case where a resin belt is used, due to differences in thermal expansion coefficient, elastic modulus or the like, between the belt, adhesive and the rib.

SUMMARY

According to an aspect of the invention, there is provided a belt comprising a belt base having elasticity and a projection member having elasticity which is provided along at least one edge of the belt base so as to project from the belt base, and an adhesive layer which bonds the belt base and the projection member, wherein the ten-point average roughness Rz in the region of the belt base to be bonded with the projection member is about 4 μm or more and the ten-point average roughness Rz in the region of the projection member to be bonded with the belt base is about 6 μm or more.

BRIEF DESCRIPTION OF THE DRAWINGS

Exemplary embodiments of the present invention will be described in detail based on the following figures, wherein:

FIGS. 2A and 2B are views showing a method of measuring the volume resistivity used in the invention, wherein FIG. 2A is a plan view and FIG. 2B is a sectional view of FIG. 2A along the line X-X;

DETAILED DESCRIPTION

Figure 1:
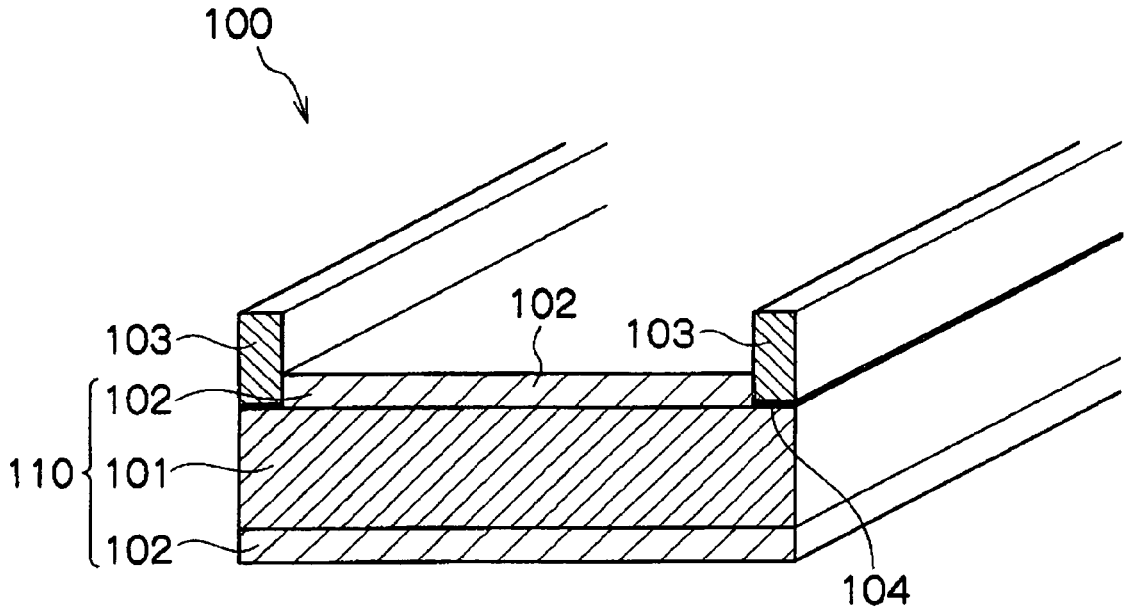
FIG. 1 is a schematic sectional view showing one exemplary embodiment of layer structure of a semiconductive belt which is an exemplary embodiment according to the invention.

The present invention will now be explained in detail. First, the belt of the invention will be explained in detail, and next the image forming device of the invention will be explained. Members having substantially same functions are represented by the same symbols in all drawings, and duplicative explanations are omitted.

<Belt>

The belt of the invention includes a belt base having elasticity, a projecting member having elasticity and provided along at least one edge of the belt base so as to project from the belt base (hereinafter, referred to as "rib" as appropriate), and an adhesive layer which bonds the belt base and the projecting member, wherein the belt base has a ten-point average roughness Rz of 4 μm or more in the region where the belt base is bonded to the projecting member, and the projecting member has a ten-point average roughness Rz of 6 μm or more in the region where the projecting member is bonded to the belt base.

According to the invention, by producing the belt by bonding the belt base and the projection member with the adhesive layer, wherein the surface roughness of the belt base in the region to be bonded to the projecting member and the surface roughness of the projection member (rib) in the region to be bonded to the belt base satisfy the above ranges, peeling of the rib may be avoided even if repetitive stress is applied intensively on the rib.

The region of the belt base to be bonded to the projecting member means a region on one surface of the belt base which is used to be bonded to the projecting member. The region is to be in contact with the adhesive layer, and required to have the size being at least equal to the surface of the projecting member to be in contact with the adhesive layer (adhesion surface).

On the other hand, the region of the projecting member to be bonded to the belt base means a surface to be in contact with the adhesive layer (adhesion surface) which is used to bond the projecting member to the belt base.

The surface of the belt base to which the projecting member is bonded is preferably the inner peripheral surface of the belt.

In the invention, the ten-point average roughness Rz in the region of the belt base to be bonded to the projecting member (hereinafter, simply referred to as "ten-point average roughness Rz (B)" in some cases) is 4 μm or more, preferably 6 μm or more, and more preferably 10 μm or more. Also, the upper limit of the ten-point average roughness Rz (B) is preferably 40 μm, and more preferably 30 μm from the viewpoint of aesthetic sense and reduction in strength due to scratches.

The belt base of the invention may have a structure in which various kinds of layer (for example, a protective layer to be explained later) are formed on a substrate, or may be composed of only substrate, as long as the belt base has elasticity. For example, in the case of a belt base having a structure in which a protective layer is formed on a substrate, the belt base may be bonded to the projecting member (rib) in the region from which the protective layer is removed and the substrate is exposed, or in the region where the protective layer is formed, as long as the ten-point average roughness Rz (B) of the region is 4 μm or more.

Also, the ten-point average roughness Rz in the region of the rib to be bonded to the belt base (hereinafter, simply referred to as "ten-point average roughness Rz (R)" in some cases) is 6 μm or more, preferably 10 μm or more, and more preferably 15 μm or more. Also, the upper limit of the ten-point average roughness Rz (R) is preferably 40 μm, and more preferably 30 μm from the viewpoint of aesthetic sense and reduction in strength due to scratches.

In the invention, the ten-point average roughness Rz (R) is preferably equal to or larger than the ten-point average roughness Rz (B), and more preferably larger than the ten-point average roughness Rz (B).

The ten-point average roughness Rz in the invention is measured by a method in compliance with JIS B0601 (1994). Specifically, it may be measured by a surface roughness shape measuring device (trade name: Sirfcom 1400, manufactured by TOKYO SEIMITSU Co., Ltd.). Measuring conditions are as follows: cutoff: 0.8 mm, measuring length: 2.4 mm and traverse speed: 0.3 mm/s.

In the belt of the invention, the ten-point average roughness Rz (B) and the ten-point average roughness Rz (R) are measured only at the parts where the adhesive layer (adhesive) does not exist, when the belt base is peeled off from the rib by a T-type peeling or a thrust-direction peeling. When there is no part without the adhesive layer, only the adhesive layer is dissolved with a solvent.

In the invention, it is required that the belt base and the rib have elasticity. Here, the description "having elasticity" means that a durometer hardness in compliance with JIS K6253 (1997) Type A Durometer is about A85/S or less. By using the belt base and the rib having such elasticity, a belt being superior in transferring and paper-conveying properties may be obtained.

In the invention, the durometer hardness is preferably about A80/S or less, from the viewpoint of transferring and paper-conveying properties. Also, the lower limit of the durometer hardness is preferably A50/S from the viewpoint of bleeding.

In the invention, the belt base and the rib are preferably made of the same material.

The adhesive layer that bonds the belt base and the rib preferably has a durometer hardness in compliance with JIS K6253 (1997) Type A Durometer of A50/S or less, and more preferably about A45/S or less, from the viewpoint of flexibility. Also, the lower limit of the durometer hardness is preferably about A20/S, and more preferably about A30/S.

It is required that the projecting member (rib) of the invention is provided along at least one edge of the belt base so as to project from the belt base. In this case, the projecting member may be continuously formed along the whole periphery of the edge of the belt base (belt-shaped member), or may be formed intermittently along the edge of the belt base. When the rib is formed intermittently along the edge of the belt base, it is required that intervals between the projecting members are smaller than the area where the belt is in contact with a tension roll on which the belt is trained. Smaller interval is more preferable from the viewpoint of controlling belt walk.

In the case where the projecting member (rib) is belt-shaped, the member is preferably seamless.

When the rib of the invention is a seamless belt-shaped member, the outer diameter of the rib is preferably equal to or larger than the inner diameter of the belt base, before bonding. When the above relationship is satisfied, the rib and the belt may be bonded together with high precision by using a method in which the belt base is brought into contact with the outside of the rib, while being expanded in diameter, after application of an adhesive onto the outer peripheral surface of the rib.

In the invention, the adhesive strength between the belt base and the projecting member in a thrust direction is preferably about 3.0 N/mm or more, and more preferably about 6.0 N/mm or more.

A method for measuring the adhesive strength between the belt base material and the projecting member in a thrust direction will be described later.

The belt of the invention may be applied to various belt devices and there is no particular limitation in its use. However, it is preferably a semiconductive belt, and more preferably a semiconductive belt which is applied to an image forming device utilizing an electrophotographic system.

In the invention, the term "semiconductive" in the semiconductive belt means that the volume resistivity of the belt in a state of being not expanded is in the range of about $10^7$ to $10^{11}$ Ωcm.

In the following, explanations according to the belt of the invention will be given as preferred exemplary embodiments of a semiconductive belt.

—Structure of Semiconductive Belt—

The structure of a semiconductive belt 100 in the invention will be explained with reference to FIG. 1.

As shown in FIG. 1, the semiconductive belt 100 preferably has, but not particularly limited to, a protective layer 102 on the substrate 101, which coats the surface of the substrate 101. In FIG. 1, the protective layer 102 is formed on both sides of the substrate 101. However, the protective layer 102 may also be formed on only one side of the substrate 101.

In FIG. 1, the protective layer 102, which is formed on the side of the substrate 101 to be provided with a rib 103 (projecting member), is not formed in the region where the substrate 101 is bonded with the rib 103 (namely, the substrate 101 is bonded with the rib 103 via an adhesive layer 104). However, the protective layer 102 may also be formed in the region where the substrate 101 is bonded with the rib 103.

The belt base 110 of the invention is composed of the substrate 101 and the protective layer 102.

The belt base 110 may be either seamless or not.

The size of the belt base 110 may be selected as appropriate according to usage. The thickness of the substrate 101 constituting the belt base 110 is preferably in the range of 300 to 900 μm, and more preferably 400 to 700 μm.

As shown in FIG. 1, the rib 103 is formed on both ends of the belt base 110 (substrate 101) in the width direction. However, in another exemplary embodiment, the rib 103 may be formed on only one end of the belt base 110. Also, the rib 103 may be formed on either outer or inner peripheral surface of the belt base 110. However, the rib 103 is preferably formed on the inner peripheral surface where the tension rolls exist.

Also, the belt may have a structure in which the rib 103 is formed in a continuous manner along the edge of the belt base 110, or a structure in which the rib 103 is formed in an intermittent manner along the edge of the belt base 110.

The shape of the cross-section (cross-section in the direction of the axis of the semiconductive belt 100) of the rib 103 may be designed as appropriate according to working conditions. However, it is preferable to make the rib 103 almost rectangular to have a surface to be in contact with a tension roll, from the viewpoint of developing the ability to efficiently suppress the belt walk of the rib.

The width of the rib 103 is preferably about 100 μm to 5000 μm, and particularly preferably 300 μm to 1000 μm, from the viewpoint of efficiently developing the ability of the rib, durability and the like.

Also, although not particularly limited, the thickness (height) of the rib 103 is preferably determined so as to project from the surface, by about 1 to 5 mm and particularly preferably about 3 to 5 mm, from the viewpoint of efficiently developing the ability of the rib, durability and the like.

The substrate 101 and the rib 103 are respectively preferably composed of an elastic body (elastic material) and may further contain a conductive agent or may not.

Also, the substrate 101 and the rib 103 are preferably composed of the same material.

The above elastic body is preferably a diene-based or non-diene-based rubber elastic body. Examples of materials for such rubber elastic body may be either in a state of solid or liquid, and include acryl rubber, isoprene rubber, butadiene rubber, ethylene/propylene copolymer rubber, acrylonitrile/butadiene rubber, styrene/butadiene rubber, epichlorohydrin copolymer rubber, urethane rubber, silicone rubber, butyl rubber, chloroprene rubber, norbornane and hydrogenated polybutadiene. Among these compounds, ethylene/propylene copolymer rubber, acrylonitrile/butadiene rubber, styrene/butadiene rubber, epichlorohydrin copolymer rubber and chloroprene rubber are more preferable. The above elastic materials may be used alone or by blending two or more.

Also, materials which may be usually added to rubbers, such as a softener, plasticizer, curing agent, vulcanizing agent, vulcanization accelerator, aging preventive, and fillers such as silica and calcium carbonate, may be added to the substrate 101 and the rib 103.

As a conductive agent suitable for the material constituting the substrate 101 and the rib 103, conductive or semiconductive micropowders may be used. Although not particularly limited as long as a desired electric resistance may be obtained stably, examples of conductive agent include carbon blacks such as ketchene black and acetylene black, metals such as aluminum and nickel, conductive metal oxides such as tin oxide and potassium titanate. Among these compounds, carbon blacks and conductive metal oxides are particularly preferable. These compounds may be used either alone or in combination of two or more.

The protective layer 102 is a layer which is provided on the surface of the substrate 101 in such a manner that the backside of the protective layer 102 comes in contact with the surface of the substrate 101 and constitute the outermost layer of the semiconductor belt 100.

Examples of the material forming the protective layer 102 include resins of urethane, polyester, phenol, acryl, polyurethane, epoxy and cellulose.

Also, the protective layer 102 may contain conductive or semiconductive micropowders. As the particulate conductive agent, those having a volume average particle diameter of 3 μm or less and a volume resistivity of $10^9$ Ωcm or less are preferable. Specifically, for example, metal oxides such as tin oxide, titanium oxide and zinc oxide, microparticles of alloys of these metals, and carbon blacks such as ketchene black and acetylene black may be used.

Further, the protective layer 102 may contain a fluorine-based or silicone-based resin or microparticles.

Also, a coupling agent may be added in the protective layer 102 to improve adhesion to the substrate 101.

As an adhesive layer 104 that bonds the substrate 101 and the rib 103, conventionally known adhesives may be used. However, adhesives which ensure that the adhesive layer 104 has elasticity are preferably used. Preferable examples of adhesive include PM 100, PM 155, PM165, PM300, PM200, EP001, Super X, SX720WH, SX720B and SX720BH, manufactured by Cemedine Co., Ltd.

The thickness of the adhesive layer is preferably in the range of 1 to 500 μm from the viewpoint of flexibility, although there is no particular limitation as long as adhesive strength between the substrate 101 and the rib 103 is within the aforementioned range.

—Production of Semiconductive Belt—

For production of a semiconductive belt, the method may be suitably selected as appropriate from known methods.

When manufacturing the substrate 101 and the rib 103, in particular, a method may be desirably used in which an extruded material is applied onto a metal pipe and vulcanized, so that both substrate 101 and rib 103 may be molded into a form of seamless belt.

To produce a semiconductive belt shown in FIG. 1, by bonding the belt base 110 provided with the substrate 101 with the belt-shaped rib 103 (belt member), the following method may be preferably used, specifically:

Applying an adhesive onto the outer peripheral surface of the rib 103;

Positioning the adhesive-applied outer peripheral surface of the rib 103 to the region of the belt base 110 to be bonded with the rib 103 (the surface of the substrate 101 is exposed; the region to be in contact with the adhesive layer 104), as expanding the diameter of the inner peripheral surface of the belt base 110;

Returning the expanded belt base 110 to the state of normal diameter to allow the outer peripheral surface of the rib 103 to come in contact with the belt base 110 (substrate 101); and Allowing the adhesive to cure to form the adhesive layer 104, thus completing bonding of the belt base 110 and the rib 103.

—Properties of Semiconductive Belt—

In the semiconductive belt of the invention, ten-point average roughness Rz in compliance with JIS B0601 (1994) of the region of the belt base other than the region to be bonded with the projecting member is preferably 10 μm or less, and more preferably 8 μm or less. The lower limit of the ten-point average roughness Rz is, though not particularly limited to, 1.0 μm or more from the viewpoint of tackiness with a photoreceptor drum.

Measurement for this surface roughness may be conducted according to the same method used for measuring the aforementioned ten-point average roughness Rz (B) and ten-point average roughness Rz (R).

The semiconductor belt has a permanent stretch prescribed in JIS K6262 (1998) of preferably 10% or less, and more preferably 5% or less.

By using the semiconductive belt of the invention as an intermediate transfer belt or a transfer conveyer belt in an image forming device as described later, when the volume resistivity of the semiconductive belt not being expanded is in the range of about $10^7$ to $10^{11}$ Ωcm, desirable transfer ability may be obtained.

A method of measuring the volume resistivity in the invention will now be explained.

Figure 2A:
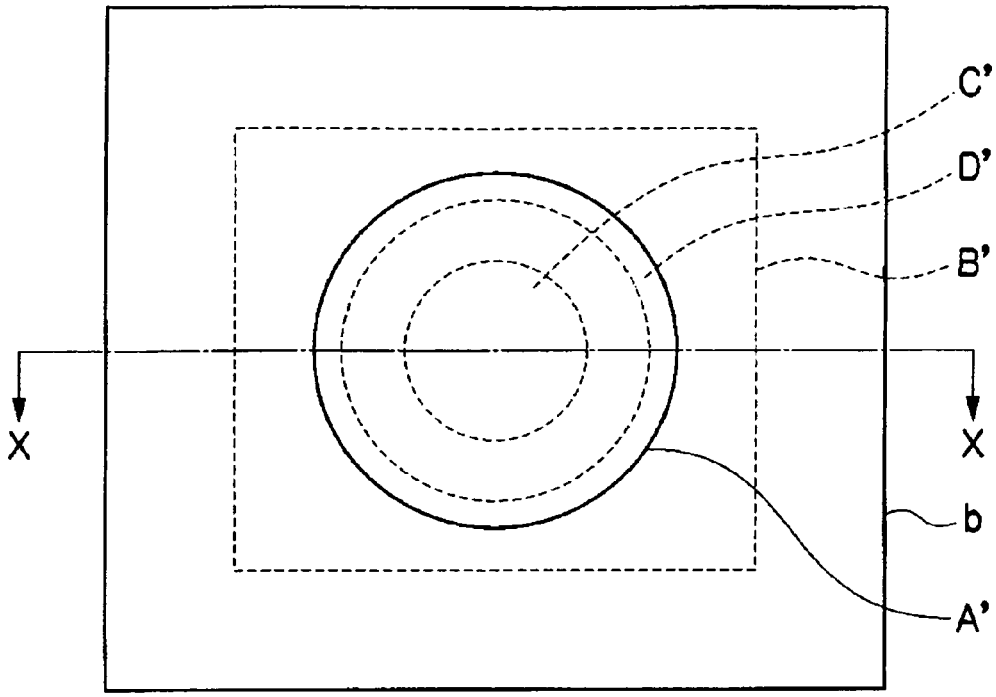
Figure 2B:
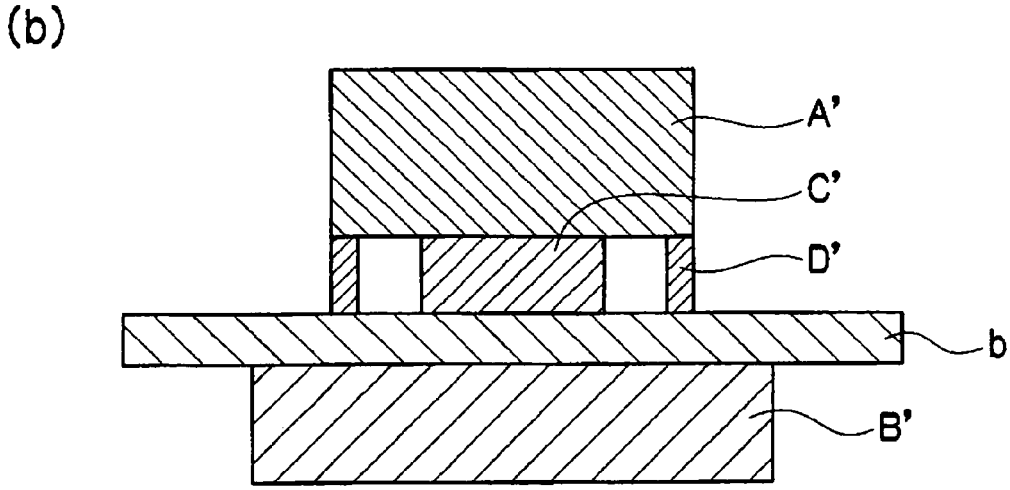

The volume resistivity of the semiconductive belt was measured using a circular electrode (for example, Hiresta UPMCP-450 model UR Probe manufactured by Dia Instrument Co., Ltd.), in compliance with JIS K 6911 (1995). The method used to measure the volume resistivity will be explained with reference to FIGS. 2A and 2B. FIGS. 2A and 2B show an example of the circular electrode, a plan view and a sectional view along the line X-X, respectively. The circular electrode shown in FIGS. 2A and 2B is provided with a first voltage applying electrode A' and a second voltage applying electrode B'. The first voltage applying electrode A' is provided with a cylindrical electrode portion C' and a cylindrical ring-shaped electrode portion D', wherein the inner diameter thereof is larger than the outer diameter of the cylindrical electrode portion C', and positioned to surround the cylindrical electrode portion C' leaving a certain space in between. A semiconductive belt b is sandwiched between the cylindrical electrode portion C' and the ring-shaped electrode portion D' in the first voltage applying electrode A', and the second voltage applying electrode B'. By measuring a current I (A) which flows when a voltage V (V) is applied between the cylindrical electrode portion C' in the first voltage applying electrode A' and the second voltage applying electrode B', the volume resistivity ρv (Ωcm) of the semiconductive belt b can be calculated according to the following equation. In the formula, t represents a thickness of the semiconductive belt b.

$$\rho v = 19.6 \times (V/I) \times t \qquad \text{Formula:}$$

Measurement is conducted by applying a voltage of 500 (V) between the cylindrical electrode portion C' in the first voltage applying electrode A' and the second voltage applying electrode B', under the condition of 22° C./55% RH, then the volume resistivity is calculated from the current value of 10 seconds after. In the sample, values are measured at 3 points in the direction of length and at 8 points in the peripheral direction, thus measured at 24 points in total, are averaged to obtain the volume resistivity of the semiconductive belt.

<Image Forming Device>

The image forming device of the invention will now be explained. The image forming device of the invention includes the belt of the invention. In the image forming device of the invention, the belt is used as the intermediate transfer belt or the transfer conveyer belt in a preferred exemplary embodiment.

First, explanations will be given as to an image forming device provided with the belt of the invention as the intermediate transfer belt. In the case of an image forming device using the belt of the invention as the intermediate transfer belt, the intermediate transfer belt being expanded by plural tension rolls and positioned so as to be in contact with a photoreceptor drum along the shape of the drum, and either of the photoreceptor drum or the intermediate transfer belt acting as a driving source while the other being rotated in subordination, is a preferred exemplary embodiment.

Figure 3:
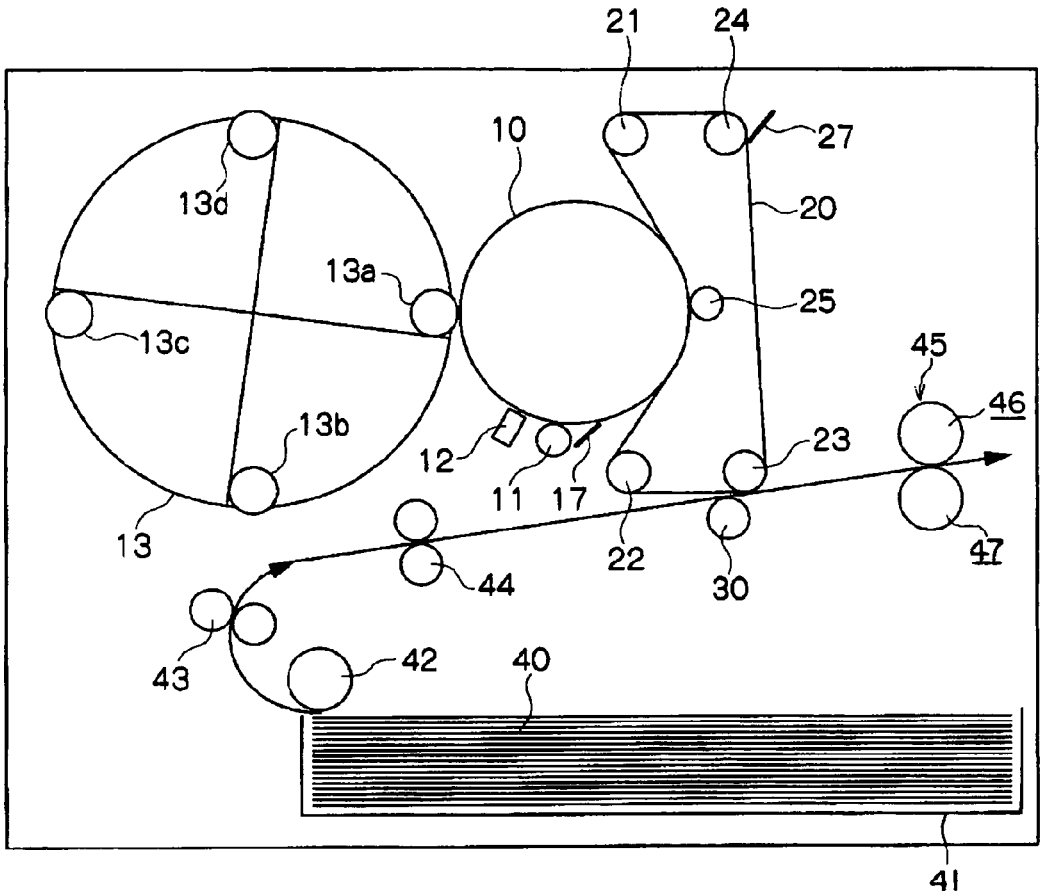
FIG. 3 is a schematic structural view showing one exemplary embodiment of the image forming device according to the invention.

FIG. 3 is a schematic structural view showing one exemplary embodiment of an image forming device of the invention.

The image forming device of the invention includes a photoreceptor drum 10 and an intermediate transfer belt 20 positioned so as to be in contact with the photoreceptor drum 10 along the outer peripheral surface of the drum for transferring a toner image from the photoreceptor drum 10. In this exemplary embodiment, the photoreceptor drum 10 is provided with a photosensitive layer in which resistance decreases by irradiating light. Around the photoreceptor drum 10, there are arranged a charging device 11 which charges the photoreceptor drum 10, an exposure device 12 which forms latent images of each color component (black, yellow, magenta and cyan in this exemplary embodiment) on the photoreceptor drum 10, a rotary-type developing device 13 which visualizes the latent images of each color component formed on the photoreceptor drum 10 with toner of each color component, an intermediate transfer belt 20, and a cleaning device 17 which removes residual toners on the photoreceptor drum 10.

The image forming device of the invention uses a semiconductive belt 100, one of the belt of the invention, as the intermediate transfer belt 20.

Here, a charging roll may be used, for example, as the charging device 11. However, a charging device such as corotron may also be used.

Also, any device may be used for the exposure device 12 as long as the device can form an image on the photoreceptor drum 10 by means of light. For example, a print head utilizing an LED may be used, but other devices may also be selected as appropriate, such as a print head using an EL, a scanner which scans a laser beam by using a polygon mirror.

Moreover, a rotary-type developing device 13 is provided with developing units 13*a* to 13*d* which contain each color component toner and mounted on the rotary-type developing device 13 in a rotatable manner. Any type of such developing device may be suitably selected, as long as it applies each color component toner onto the area on the photoreceptor drum 10 where the potential is dropped, by exposing. Also, toner having any shape or size may be used, as long as it can be applied onto the electrostatic latent image on the photoreceptor drum 10 with high precision. However, it is preferable to use spherical toners from the viewpoint of obtaining favorable image quality.

Although the rotary-type developing device 13 is used in this exemplary embodiment, a system including four developing devices may be used.

As the cleaning device 17, any type of device such as a device applying a blade cleaning system may be used as appropriate, as long as it removes a residual toner on the photoreceptor drum 10.

However, in some cases where a toner having a high degree of transfer efficiency such as a spherical toner, the cleaning device 17 may not be used.

In one exemplary embodiment of the invention, the intermediate transfer belt 20 is trained over four tension rolls 21, 22, 23 and 24 in an expanded manner, wherein the side on which the rib is formed faces inside. By being trained over the four tension rolls 21, 22, 23 and 24, the intermediate transfer belt 20 is positioned so that a certain area of the outer peripheral surface of the belt is in contact with the photoreceptor drum 10 between the rotary-type developing device 13 and the cleaning device 17, along the outer peripheral surface of the drum.

A primary transfer roll 25 is positioned from the backside of the intermediate transfer belt 20 so as to be in contact with a part of the area where the intermediate transfer belt 20 and the photoreceptor drum 10 are in contact with each other, and a specified primary transfer bias is applied to the primary transfer roll 25. In the region (hereinafter referred to as a primary transfer region) sandwiched between the primary transfer roll 25 and the photoreceptor drum 10, a toner image formed on the photoreceptor drum 10 (to be described later) is transferred to the surface of the intermediate transfer belt 20.

Further, a secondary transfer roll 30 which serves as a backup roll for the tension roll 23 is positioned in an opposed manner to the tension roll 23 as a secondary transfer device, at the position where the secondary transfer roll 30 and the tension roll 23 of the intermediate transfer belt 20 are opposed to each other. In a preferred exemplary embodiment, the secondary transfer roll 30 is applied a predetermined bias and the tension roll 23 which also serves as a backup roll is grounded.

In addition, a cleaning device 27 is disposed on the outer peripheral surface of the intermediate transfer belt 20. However, the cleaning device 27 may not used in some exemplary embodiments.

In one exemplary embodiment of the invention, the intermediate transfer belt 20 and the photoreceptor drum (image carrier) 10 are positioned such that the both are in contact with each other along the peripheral surface, in a relatively wide range in the above primary transfer region. Therefore, a system may be applied in which either of the intermediate transfer belt 20 or the photoreceptor drum 10 acts as a driving source, while the other is rotated in subordination. For example, the photoreceptor drum 10 may be used as a driving source and the intermediate transfer belt 20 may be driven and rotated by the photoreceptor drum 10. In this system, a driving mechanism of the one in subordination to the other may be omitted, thus downsizing the device and lowering the cost.

The intermediate transfer belt 20 and the photoreceptor drum 10 may also be driven by each separate driving system, respectively.

A recording medium 40 such as a sheet of paper is stored in a supply tray 41. The recording medium 40 is fed onto a conveying path inside the image forming device by a feed roll 42, through conveyer rolls 43 and registration rolls 44, then conveyed to the region where the medium is sandwiched between the tension roll 23 and the secondary transfer roll 30 (hereinafter, referred to as a secondary transfer region as appropriate), where a toner image which has been transferred onto the intermediate transfer belt 20 is transferred onto the recording medium 40. Thereafter, the recording medium 40 is conveyed to a position at which a fixing device 45 including a fixing roll 46 and a pressure roll 47 is present, where the toner image on the recording medium 40 is fixed onto the recording material 40 by the fixing device 45. The recording medium 40 onto which the toner image is fixed is conveyed out of the image forming device by a conveyer roll (not shown in the figure).

Next, operation of the image forming device of the invention shown in FIG. 3 will be explained. Toner images of each color component are formed in sequence on the photoreceptor drum 10. The toner images formed on the photoreceptor drum 10 are transferred one by one to the intermediate transfer belt 20, at the region where the photoreceptor drum 10 is in contact with the intermediate transfer belt 20, then the toner images are transferred collectively onto the recording material 40. In such an image-forming process, the photoreceptor drum 10 and the intermediate transfer belt 20 are positioned in such a manner that the both are in contact with each other at the region being relatively wide, and also the photoreceptor drum 10 is pressed elastically by the elastic intermediate transfer belt 20. Therefore, the nip (tack) plane pressure applied in between the photoreceptor drum 10 and the intermediate transfer belt 20 is not higher as compared with the case where the contact area is smaller. Also, the toner image on the photoreceptor drum 10 is primarily transferred onto the intermediate transfer belt 20 side, by being embraced in the elastic intermediate transfer belt 20. Therefore, the image transferred onto the intermediate transfer belt 20 may be free of defects in image quality such as holowcharacter due to a large pressure of the nip area, the image is transferred with high transfer efficiency and the color image quality on the recording material 40 may be maintained favorably.

In the following, an exemplary embodiment of an image forming device provided with the belt of the invention as a transfer conveyer belt will be explained.

Figure 4:
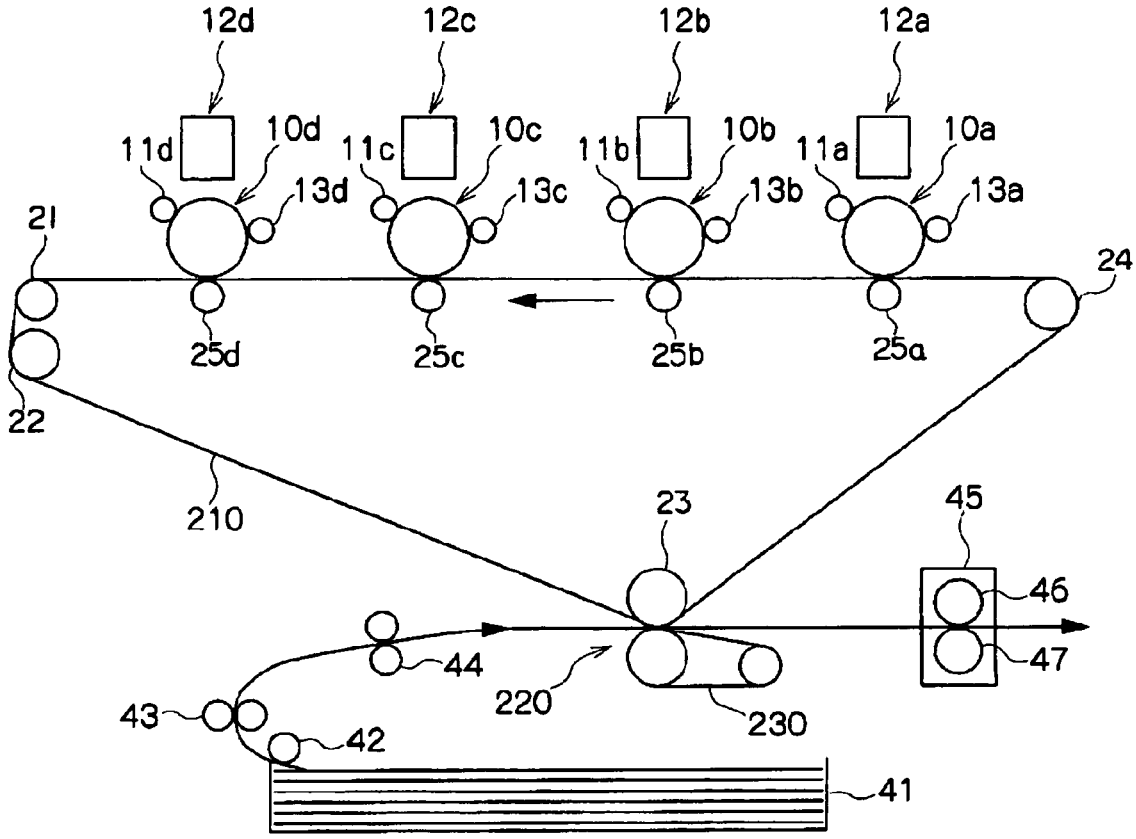
FIG. 4 is a schematic structural view showing one exemplary embodiment of the image forming device according to the invention.

FIG. 4 is a schematic structural view showing another exemplary embodiment of the image forming device of the invention.

As shown in FIG. 4, the image forming device of the invention is a tandem type image forming device and is provided with plural photoreceptor drums 10*a* to 10*d* onto which each color component toner image is respectively formed by an electrophotographic system, an intermediate transfer belt 210 (toner image retainer) which retains each toner image of color component transferred (primary transfer) one by one, a secondary transfer device 220 which transfers (secondary transfer) the superposed images which have been transferred to the intermediate transfer belt 210 onto a transfer medium collectively, and a fixing device 45 which fixes the secondarily transferred image to the transfer medium.

In this exemplary embodiment, a material prepared by containing an appropriate amount of conductive agent such as carbon black in a resin such as polyimide, polyamide-imide or polyamide may be used for the intermediate transfer belt 210 which is an intermediate transfer body. The intermediate transfer belt 210 is preferably composed of a film-shaped seamless belt that is formed so as to have a volume resistivity of $10^6$ to $10^{14}$ Ωcm and a thickness of about 0.1 mm.

The secondary transfer device 220 is provided with a secondary transfer belt 230 (transfer/conveyer belt) disposed on the toner image-retaining side of the intermediate transfer belt 210.

The image forming device of the invention uses a semiconductive belt 100, one of the belt of the invention as described before, as the transfer/conveyer belt 230, with the side on which the rib is formed facing inside.

Operation of the image forming device of the invention shown in FIG. 4 will now be explained.

Each toner image is formed on the photoreceptor drums 10*a* to 10*d*. Each toner image formed on the photoreceptor drums 10*a* to 10*d* is primarily transferred to the intermediate transfer belt 210. When the toner image on the intermediate transfer belt 210 is secondarily transferred onto the recording medium 40 which has been fed out from a supply tray 41, the recording medium 40 may be prevented from adhering to the side of the intermediate transfer belt 210, even in a high-speed image forming device, by using the transfer/conveyer belt 230, thus suppressing occurrence of paper clogging in the image forming device. Consequently, the image forming device of the invention may contribute to high reliability.

As mentioned above, by using the belt of the invention as the intermediate transfer belt and the transfer belt, occurrence of belt walk may be suppressed, therefore the image forming device of the invention may contribute to achieve excellent image quality and transfer ability.

EXAMPLES

In the following, the invention will be explained in more detail with reference to the examples. However, these examples are not intended to limit the scope of the invention. All designations of merely "parts" indicate "parts by weight", unless otherwise specified.

Example 1

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front surface of the obtained belt base is spray-coated with JLY-601ESD (manufactured by Acheson (Japan) Limited). The backside of the belt base is partially masked such that the portion (a width of 5 mm from the edge part), where a rib is to be bonded, is not applied a coating solution, then the other part is spray-coated. Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the masked portion for bonding is 4 μm, and the ten-point average roughness Rz of the surface on which the protective layer is formed is 2 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 6 μm. In this way, two ribs are prepared.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Example 2

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front surface of the obtained belt base is spray-coated with JLY-601ESD (manufactured by Acheson (Japan) Limited). The backside of the belt base is partially masked such that the portion (a width of 5 mm from the edge part), where a rib is to be bonded, is not applied a coating solution, then the other part is spray-coated. Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the masked portion for bonding is 4 μm, and the ten-point average roughness Rz of the surface on which the protective layer is formed is 2 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 10 μm. In this way, two ribs are prepared.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Example 3

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front and back surfaces of the obtained belt base is spray-coated with JLY-601ESD (manufactured by Acheson (Japan) Limited). Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the surfaces on which the protective layer is formed is 2 μm.

(Processing of Bonding Region of Back Surface of Belt)

On the back surface of the belt base on which the protective layer is formed, 5 mm in width from the edge to be the bonding region is polished with sandpaper to remove the protective layer so that the ten-point average roughness Rz(B) of the region is 10 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 6 μm. In this way, two ribs are prepared.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Example 4

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front and back surfaces of the obtained belt base is spray-coated with JLY-601ESD (manufactured by Acheson (Japan) Limited). Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the surfaces on which the protective layer is formed is 2 μm.

(Processing of Bonding Region of Back Surface of Belt)

On the back surface of the belt base on which the protective layer is formed, 5 mm in width from the edge to be the bonding region is polished with sandpaper to remove the protective layer so that the ten-point average roughness Rz(B) of the region is 10 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 10 μm. In this way, two ribs are prepared.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Example 5

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front and back surfaces of the obtained belt base is spray-coated with JLY-601ESD (manufactured by Acheson (Japan) Limited). Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the surfaces on which the protective layer is formed is 2 μm.

(Processing of Bonding Region of Back Surface of Belt)

On the back surface of the belt base on which the protective layer is formed, 5 mm in width from the edge to be the bonding region is polished with sandpaper to remove the protective layer so that the ten-point average roughness Rz(B) of the region is 6 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 10 μm. In this way, two ribs are prepared.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Example 6

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front and back surfaces of the obtained belt base is spray-coated with JLY-601 ESD (manufactured by Acheson (Japan) Limited). Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the surfaces on which the protective layer is formed is 2 μm.

(Processing of Bonding Region of Back Surface of Belt)

On the back surface of the belt base on which the protective layer is formed, 5 mm in width from the edge to be the bonding region is polished with sandpaper to remove the protective layer so that the ten-point average roughness Rz(B) of the region is 10 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 15 μm. In this way, two ribs are prepared.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Comparative Example 1

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The surface of the obtained belt base is spray-coated with JLY-601ESD (manufactured by Acheson (Japan) Limited). The backside of the belt base is partially masked such that the portion (a width of 5 mm from the edge part), where a rib is to be bonded, is not applied a coating solution, then the other part is spray-coated. Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the masked portion for bonding is 4 μm, and the ten-point average roughness Rz of the surface on which the protective layer is formed is 2 μm.

(Preparation of Rib)

A rib having an outer peripheral length of 128 mm, a thickness of 0.5 mm and a width of 5 mm is obtained according to the same formulation and production method as the production of the belt base. The ten-point average roughness Rz (R) of the region (the entire area of outer peripheral surface of the rib) of the obtained rib is 4 μm.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

Comparative Example 2

(Preparation of Belt Base)

50 parts of polychloroprene rubber (trade name: ES-40, manufactured by Denki Kagaku Kogyo Kabushiki Kaisha), 50 parts of epichlorohydrin copolymer (trade name: Zechlone 3106, manufactured by Zeon Corporation), 30 parts of carbon (trade name: Asahi Thermal, manufactured by Asahi Carbon Co., Ltd.), 5 parts of Ketchen Black EC (manufactured by Lion Corporation), 5 parts of zinc oxide (trade name: Zinc White No. 1, manufactured by Nippon Chemical Industrial Co., Ltd.), 5 parts of magnesium oxide (trade name: Kyowa Mag 150, manufactured by Kyowa Chemical Industry Co., Ltd.), 10 parts of process oil (trade name: Diana PW-150, manufactured by Idemitsu Kosan Co., Ltd.), 1 part of sulfur (trade name: #200, manufactured by Tsurumi kagaku Kogyo), 1 part of a vulcanization accelerator (trade name: Nokseller TS, manufactured by Ouchi Shinko Chemical Industrial Co., Ltd.) and 0.5 parts of a vulcanization accelerator (trade name: Nokseller DS, manufactured by Ouchi Shinko Chemical Industrial Co., Ltd.) are kneaded, then the obtained mixture is applied onto a metal pipe by extrusion molding, thereafter vapor-vulcanization is conducted in a vulcanizing can at 160° C. for one hour. Then, the front and back surfaces of the vulcanized belt are abraded with a cylindrical grinder to obtain a belt base of 125 mm in inner peripheral length and 0.5 mm in thickness.

(Preparation of Protective Layer)

The front and back surfaces of the obtained belt base is spray-coated with JLY-601ESD (manufactured by Acheson (Japan) Limited). Thereafter, the belt base is heated at 120° C. for 30 minutes to form protective layers of 8 μm in thickness on the front surface of the belt, and 3 μm in thickness on the back surface, respectively.

The ten-point average roughness Rz (B) of the surfaces on which the protective layer is formed is 2 μm.

(Preparation of Rib)

A rib having an outer peripheral length of 128 mm, a thickness of 0.5 mm and a width of 5 mm is obtained according to the same formulation and production method as the production of the belt base. The region (the entire area of outer peripheral surface of the rib) of the obtained rib, the region at which the rib is to be bonded to the belt base, is polished with sandpaper so that the ten-point average roughness Rz (R) of the region is 10 μm.

(Bonding of Belt Base and Rib)

An adhesive (trade name: Super X, manufactured by Cemedine Co., Ltd.) is applied onto the outer peripheral surface of the obtained two ribs, and the belt base is allowed to contact the rib from the outer side thereof, as the inner peripheral surface of the belt is expanded in diameter, then the ribs are bonded to both edges of the belt base, respectively.

<Evaluation>

(Measurement of Ten-Point Average Roughness Rz (B) of Belt Base and Ten-Point Average Roughness Rz (R) of Rib)

With regard to the obtained belt, the ten-point average roughness Rz (B) of the belt base and the ten-point average roughness Rz (R) of the rib are measured in accordance with the aforementioned method.

The results are shown in Table 1.

(Measurement of Durometer Hardness of Belt Base, Rib and Adhesive Layer)

The obtained belt is subjected to a hardness test to measure the durometer hardness of the belt base, rib and the adhesive layer in accordance with JIS K6253 (1997) Type A Durometer. In the measurement, a sample is prepared by laminating each of the belt base, rib and the adhesive layer prepared in Examples and Comparative Examples to make the sample 6 mm in thickness, and the standard hardness of the sample is measured using a durometer type A (trade name: ASKER A type, manufactured by Kobunshi Keiki Co., Ltd.).

The results are shown in Table 1.

(Evaluation of Adhesive Strength Between Belt Base and Rib)

Figure 5:
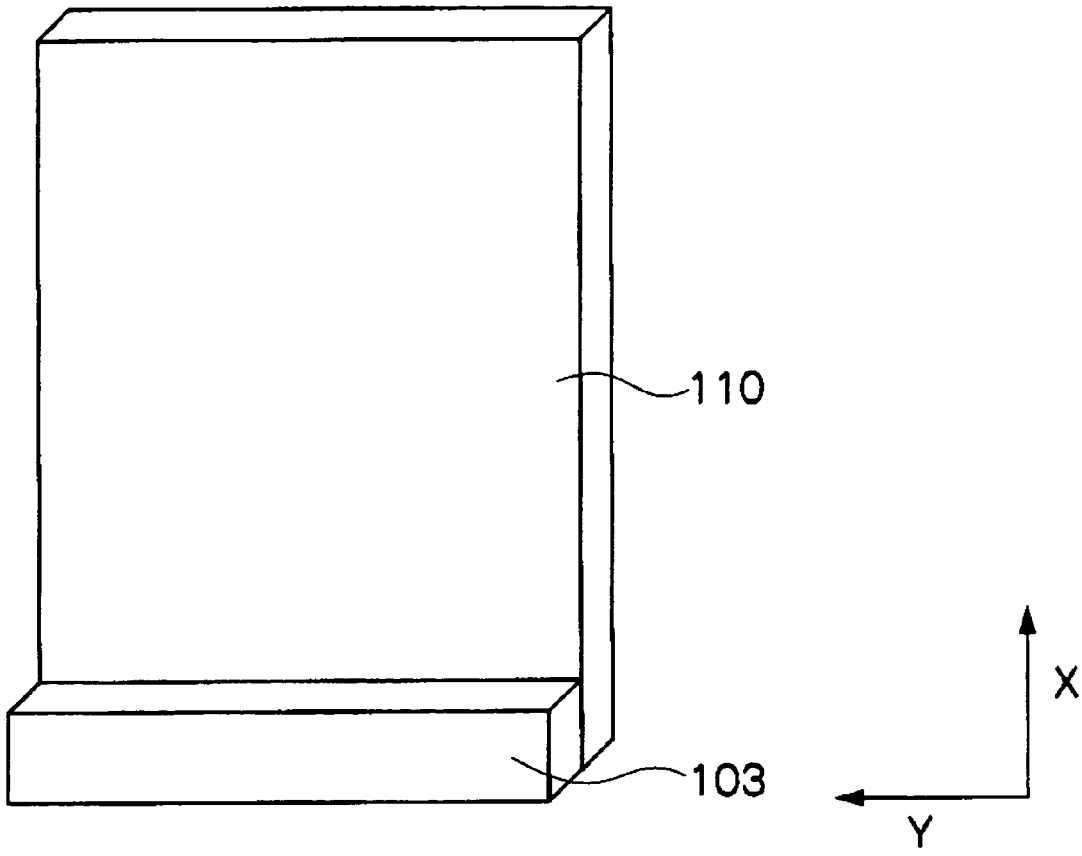
FIG. 5 is a schematic structural view of a belt used in the adhesion test of the invention.

As shown in FIG. 5, the obtained belt is cut into a test piece of 30 mm in Y direction and 50 mm in X direction.

Figure 6:
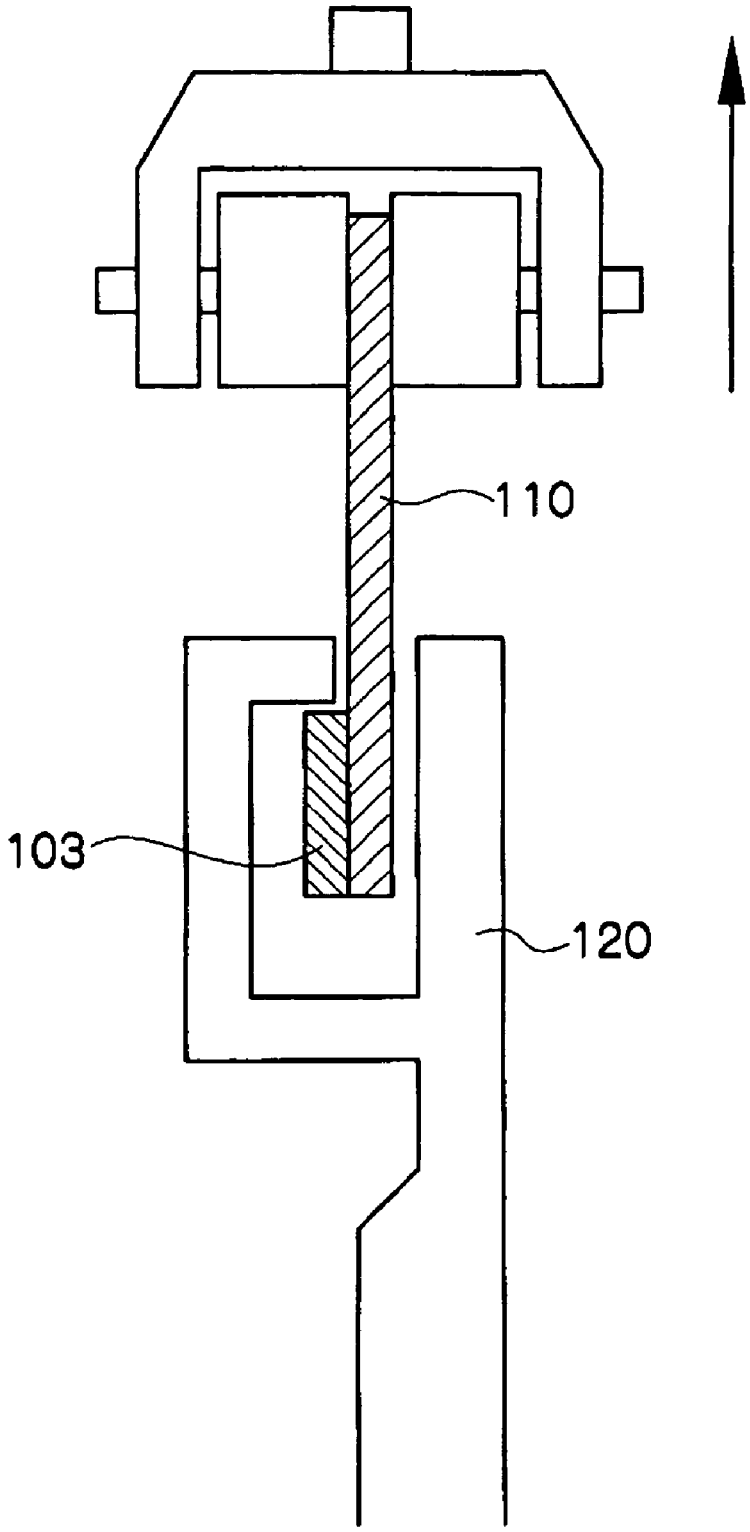
FIG. 6 is a schematic structural view showing the method of adhesion test of the invention.

This test piece is fixed to a belt fixing member 120 of 10 mm in width W, as shown in FIG. 6. Then, the test piece is pulled at a rate of 50 mm/min in the direction of the arrow. At this time, a thrust force (shear force) acts in the region where the belt base and the rib are bonded together.

The force P (N) at the time when the rib is peeled off from the belt base material is measured under the conditions of 22±2° C. and 55±5% RH, the adhesive strength P/W (N/mm) in the thrust direction is calculated from the force P (N) and the width W (mm) of the belt fixing member 120, i.e., 10 mm.

The results are shown in Table 1.

(Running Evaluation on Actual Machine)

The obtained belt is applied as a transfer conveyer belt in a DocuColor 8000 Digital Press manufactured by Fuji Xerox Co., Ltd. Evaluation is conducted by running the belt at 1000 kPV. A belt capable of running at 1000 kPV is rated as "A", a belt capable of running at 400 kPV is rated as "B", and a belt with occurrence of peeling of the rib before 400 kPV is rated as "C".

The results are shown in Table 1.

TABLE 1

| | Example 1 | Example 2 | Example 3 | Example 4 | Example 5 | Example 6 | Comparative Example 1 | Comparative Example 2 |
|---|---|---|---|---|---|---|---|---|
| Ten-point Average Roughness of Belt Base Rz(B) | 4 μm | 4 μm | 10 μm | 10 μm | 6 μm | 10 μm | 4 μm | 2 μm |
| Ten-point Average Roughness of Rib Rz(R) | 6 μm | 10 μm | 6 μm | 10 μm | 10 μm | 15 μm | 4 μm | 10 μm |
| Durometer Hardness of Belt Base | A75/S | A75/S | A75/S | A75/S | A75/S | A75/S | A75/S | A75/S |
| Durometer Hardness of Rib | A75/S | A75/S | A75/S | A75/S | A75/S | A75/S | A75/S | A75/S |
| Durometer Hardness of Adhesive layer | A45/S | A45/S | A45/S | A45/S | A45/S | A45/S | A45/S | A45/S |
| Adhesive Strength of Belt Base and Rib | 3.0 N/mm | 6.0 N/mm | 4.0 N/mm | 8.1 N/mm | 6.8 N/mm | 10 N/mm | 2.8 N/mm | 1.8 N/mm |
| Running Evaluation on Actual Machine | B | A | B | A | A | A | C | C |

As is clear from Table 1, the belt of the invention exhibits high adhesive ability between the rib and the belt base, and it is inferred that the peeling of the rib does not occur even if repetitive stress is applied intensively thereto.

Also, it is found that the provision of this belt prevents occurrence of belt walk caused by peeling of the rib.

All publications, patent applications, and technical standards mentioned in this specification are herein incorporated by reference to the same extent as if each individual publication, patent application, or technical standard was specifically and individually indicated to be incorporated by reference.

What is claimed is:

1. A belt comprising:

a belt base having elasticity;

a projection member having elasticity that is provided along at least one edge of the belt base so as to project from the belt base; and an adhesive layer that bonds the belt base and the projection member, the ten-point average roughness Rz in the region of the belt base to be bonded with the projection member being about 4 μm or more and the ten-point average roughness Rz in the region of the projection member to be bonded with the belt base being about 6 μm or more.

2. The belt according to claim 1, wherein a type A durometer hardness in compliance with JIS K6253 (1997) of both the belt base and the projection member is about A 85/S or less.

3. The belt according to claim 1, wherein a type A durometer hardness in compliance with JIS K6253 (1997) of the adhesive layer is about A 45/S or less.

4. The belt according to claim 1, wherein the projection member is a belt-shaped member that is provided continuously on the whole of the perimeter of at least one edge of the belt base.

5. The belt according to claim 4, wherein the belt-shaped member is seamless.

6. The belt according to claim 5, wherein before bonding the belt-shaped member has an outer diameter that is equal to or larger than the inner diameter of the belt base.

7. The belt according to claim 1, wherein the adhesive strength in a thrust direction of the belt base and the projection member is about 3.0 N/mm or more.

8. The belt according to claim 1, wherein a volume resistivity of the belt in a state of not being expanded is in the range of about $10^7$ to $10^{11}$ Ωcm.

9. The belt according to claim 1, wherein the ten-point average roughness Rz in the region of the projection member to be bonded with the belt base is equal to or larger than the ten-point average roughness Rz in the region of the belt base to be bonded with the projection member.

10. An image forming device comprising:

an image carrier;

a charging device that charges the surface of the image carrier;

a latent image forming device that forms a latent image on the surface of the image carrier;

a developing device that forms a toner image by developing the latent image with a toner;

a transfer device that transfers the toner image onto a recording medium;

a fixing device that fixes the toner image onto the recording medium; and a belt, the belt comprising:

a belt base having elasticity; and a projection member having elasticity that is provided along at least one edge of the belt base so as to project from the belt base; and an adhesive layer that bonds the belt base and the projection member, the ten-point average roughness Rz in the region of the belt base to be bonded with the projection member being about 4 μm or more and the ten-point average roughness Rz in the region of the projection member to be bonded with the belt base being about 6 μm or more.

11. The image forming device according to claim 10, wherein a type A durometer hardness in compliance with JIS K6253 (1997) of both the belt base and the projection member is about A 85/S or less.

12. The image forming device according to claim 10, wherein a type A durometer hardness in compliance with JIS K6253 (1997) of the adhesive layer is about A 45/S or less.

13. The image forming device according to claim 10, wherein the projection member is a belt-shaped member that is provided continuously on the whole perimeter of at least one edge of the belt base.

14. The image forming device according to claim 13, wherein the belt-shaped member is seamless.

15. The image forming device according to claim 14, wherein before bonding the belt-shaped member has an outer diameter that is equal to or larger than the inner diameter of the belt base.

16. The image forming device according to claim 10, wherein the adhesive strength in a thrust direction of the belt base and the projection member is about 3.0 N/mm or more.

17. The image forming device according to claim 10, wherein a volume resistivity of the belt in a state of not being expanded is in the range of about $10^7$ to $10^{11}$ Ωcm.

18. The image forming device according to claim 10, wherein the ten-point average roughness Rz in the region of the projection member to be bonded with the belt base is equal to or larger than the ten-point average roughness Rz in the region of the belt base to be bonded with the projection member.

* * * * *